US009488952B2

(12) United States Patent
Ikeda et al.

(10) Patent No.: US 9,488,952 B2
(45) Date of Patent: Nov. 8, 2016

(54) CLEANING DEVICE AND IMAGE FORMING APPARATUS

(71) Applicant: FUJI XEROX CO., LTD., Tokyo (JP)

(72) Inventors: Masashi Ikeda, Kanagawa (JP); Yoshinari Ueno, Kanagawa (JP); Manabu Furuki, Kanagawa (JP); Masahiro Uchida, Kanagawa (JP); Tatsuhiro Igarashi, Kanagawa (JP); Mona Tasaki, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/850,023

(22) Filed: Sep. 10, 2015

(65) Prior Publication Data

US 2016/0209798 A1 Jul. 21, 2016

(30) Foreign Application Priority Data

Jan. 19, 2015 (JP) ..... 2015-007403

(51) Int. Cl.
*G03G 21/00* (2006.01)
*B08B 1/00* (2006.01)

(52) U.S. Cl.
CPC ..... *G03G 21/0011* (2013.01); *B08B 1/005* (2013.01); *G03G 21/0094* (2013.01)

(58) Field of Classification Search
CPC ..... G03G 21/0011; G03G 21/0052; G03G 21/0094; B08B 1/005
USPC ..... 399/350, 349, 345; 15/256.5, 256.51, 15/256.52
See application file for complete search history.

(56) References Cited

U.S. PATENT DOCUMENTS

| | | | | |
|---|---|---|---|---|
| 4,702,591 | A * | 10/1987 | Tsuda | G03G 21/0029 399/345 |
| 5,122,839 | A * | 6/1992 | Siegel | G03G 21/0017 15/256.5 |
| 2009/0035036 | A1* | 2/2009 | Shirai | G03G 15/5037 399/345 |
| 2009/0129793 | A1* | 5/2009 | Milton | G03G 21/0011 399/350 X |
| 2010/0054830 | A1* | 3/2010 | Thayer | G03G 21/0029 399/350 |
| 2011/0091243 | A1* | 4/2011 | Tomino | G03G 15/5008 399/349 X |
| 2013/0195487 | A1* | 8/2013 | Yamashita | G03G 15/0189 399/66 |
| 2014/0161471 | A1* | 6/2014 | Matsuno | G03G 15/0812 399/27 |

FOREIGN PATENT DOCUMENTS

| | | |
|---|---|---|
| JP | 2008-197405 A | 8/2008 |
| JP | 2011-018043 A | 1/2011 |
| JP | 2011-070117 A | 4/2011 |

* cited by examiner

*Primary Examiner* — Sophia S Chen
(74) *Attorney, Agent, or Firm* — Oliff PLC

(57) ABSTRACT

A cleaning device includes a removal member that removes residual objects from a surface of a target cleaning body by contacting with the surface in a linear manner and rubbing against the surface and forms a piled body which is constructed of a portion of the residual objects at a contact location, and a pressure device that presses the piled body to increase a strength of the piled body.

5 Claims, 8 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2015-007403 filed Jan. 19, 2015.

BACKGROUND

Technical Field

The present invention relates to a cleaning device and an image forming apparatus.

SUMMARY

According to an aspect of the invention, there is provided a cleaning device including:

a removal member that removes residual objects from a surface of a target cleaning body by contacting with the surface in a linear manner and rubbing against the surface and forms a piled body which is constructed of a portion of the residual objects at a contact location; and a pressure device that presses the piled body to increase a strength of the piled body.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Exemplary Embodiment

Figure 1:
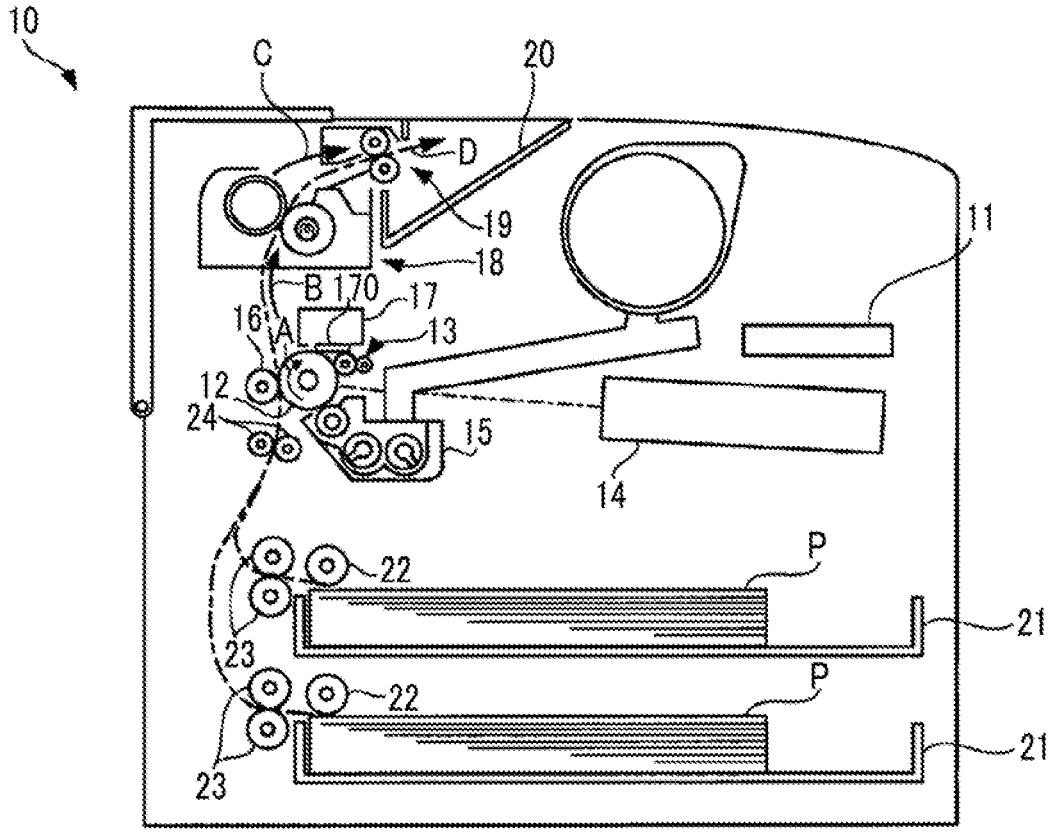
FIG. 1 is a schematic configuration drawing of a printer that is a first exemplary embodiment of an image forming apparatus of the present invention.

FIG. 1 is a schematic configuration drawing of a printer that is the first exemplary embodiment of an image forming apparatus of the present invention.

A printer 10 that is shown in FIG. 1 is a monochrome printer, and an image signal created outside the printer 10, which represented by images, is input to the printer 10 via a signal cable, which is not shown. A control unit 11, which controls the movements of each constituent element inside the printer 10, is provided in the printer 10, and the image signal are input to the control unit 11. Further, in the printer 10, the formation of images based on the image signal is performed under the control of the control unit 11.

A paper sheet tray 21 is provided in a lower section of the printer 10, and sheets of paper P are stored in the paper sheet tray 21 in a piled up state. The paper sheet tray 21 is configured so as to be capable of being freely withdrawn in order to replenish the sheets of paper P.

The sheets of paper P inside the paper sheet tray 21 are delivered to a registration roller 24 by a pickup roller 22 and a separating roller 23. A transport timing of sheets of paper P that arrive at the registration roller 24 is adjusted and the sheets of paper P are further transported.

A cylindrical photosensitive body 12, which rotates with an orientation shown by an arrow A, is provided in the printer 10 above the registration roller 24. Further, a charging unit 13, an exposure unit 14, a developing unit 15, a transfer unit 16, and a photosensitive body cleaner 17 are arranged in the vicinity of the photosensitive body 12. The photosensitive body 12 corresponds to an example of an image holding body that is referred to in the present invention, a component in which the exposure unit 14 and the developing unit 15 are combined corresponds to an example of formation equipment that is referred to in the present invention, and the transfer unit 16 corresponds to an example of a transfer device that is referred to in the present invention.

The charging unit 13 charges the surface of the photosensitive body 12, and the exposure unit 14 forms an electrostatic latent image by exposing the surface of the photosensitive body 12 in accordance with the image signal that is delivered from the control unit 11. A toner image is formed as a result of the electrostatic latent image being developed by the developing unit 15. In this instance, the exposure unit 14 may be an exposure device in which laser light is set as a light source, or may be an exposure device in which LEDs or the like are set as the light source. In addition, the developing unit 15 may be a developing device that uses a so-called two component developing agent in which a toner and a carrier are mixed, or may be a developing device that uses a developing agent in which a toner is the main component. A so-called external additive is mixed into the toner in the developing agent, the particle size of the external additive is smaller than that of toner particles, and the external additive is adhered to the surface of the toner particles. Furthermore, it is desirable that the external additive is processed with oil content such as silicone oil.

In this instance, the above-mentioned registration roller 24 feeds out sheets of paper P so as to reach a position that faces the transfer unit 16 matching a timing with which toner images on the photosensitive body 12 reach the position. Further, the toner images on the photosensitive body 12 receive the action of the transfer unit 16, and are transferred onto the sheets of paper P that are fed out.

Toner (residual toner) that remains on the photosensitive body 12 after the transfer of toner images is removed from the photosensitive body 12 by the photosensitive body cleaner 17. A rubber cleaning blade 170 is provided in the photosensitive body cleaner 17, and the cleaning blade 170 has a long plate shape that extends along a direction which the cylindrical photosensitive body 12 extends. Further, the cleaning blade 170 contacts with the photosensitive body 12 in a linear manner at a side thereof that extends along the photosensitive body 12. For convenience, there are cases in which the side that contacts with the photosensitive body 12 will be referred to as the edge of the cleaning blade 170. Since the photosensitive body 12 rotates in contrast to the cleaning blade 170 being fixed, the cleaning blade 170 rubs against the surface of the photosensitive body 12 at the edge, and scrapes away and removes residual objects (such as residual toner, the external additive that is mixed in with the toner, and paper dust that is derived from the sheets of paper P) from the surface of the photosensitive body 12 as a result of this action. This kind of cleaning blade 170 corresponds to an example of a removal member that is referred to in the present invention.

Sheets of paper P that receive the transfer of toner images progress further in the direction of an arrow B, and the toner images are fixed onto the sheets of paper P as a result of receiving heating and pressure due to a fixing unit 18. As a result of this, images that are formed from toner images are formed on the sheets of paper P.

The sheets of paper P that pass through the fixing unit 18 progress in a direction of an arrow C toward a discharge unit 19, are further delivered in a direction of an arrow D by the discharge unit 19, and are discharged to a paper discharge platform 20.

Given that, when residual objects are scraped away from the photosensitive body 12 surface by the cleaning blade 170, a portion of the scraped away residual objects remains along the edge of the cleaning blade 170, and piled bodies called toner dams and external additive dams are formed. Residual objects are reliably scraped away as a result of the presence of the piled bodies, and the maintenance of the piled bodies is important to the maintenance of the cleaning ability by the cleaning blade 170. In particular, since the particle diameter of the external additives is small, damage to the cleaning blade 170 due to abrasion is prevented by gaps between the edge and the photosensitive body 12 surface, gaps between particles of toner, and the like being filled in, and therefore, the cleaning ability of the cleaning blade 170 is improved.

However, for example, there is a concern that, the cleaning blade 170 will become damaged doe to friction with the photosensitive body 12, and therefore, the cleaning ability thereof will be reduced when the residual objects on the photosensitive body 12 are decreased and the piled bodies are reduced as a result in cases in which low concentration images are formed continuously, or the like. Further, there are cases in which striped image defects occur when the cleaning ability falls in this manner. In a case in which the toner is a toner with a small diameter of less than or equal to 4.5 μm, damage to the cleaning blade 170 is remarkable in accordance with the continuance of low concentration images.

In such an instance, a device for maintaining the piled bodies is applied to the photosensitive body cleaner 17 of the printer 10 that is shown in FIG. 1.

Figure 2:
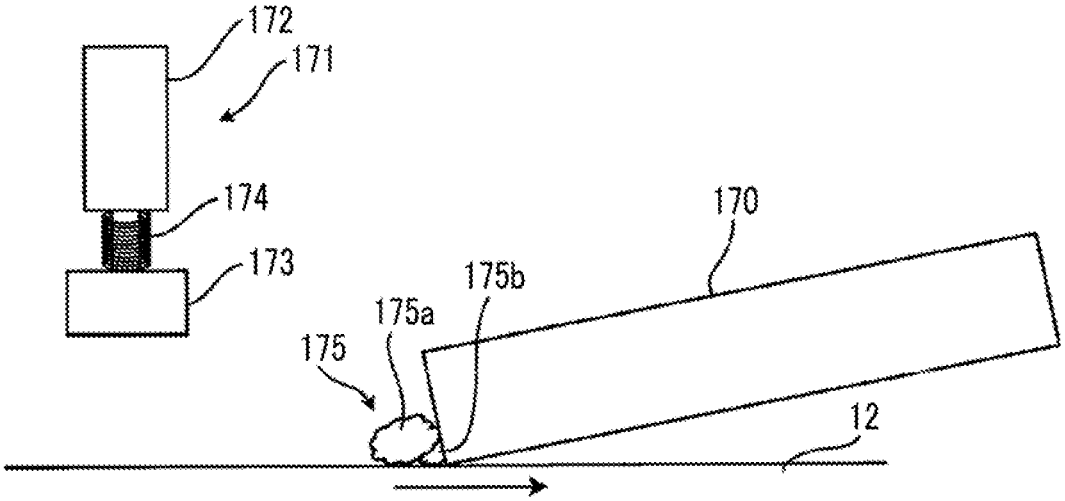
FIG. 2 is a drawing that schematically shows a cleaning blade periphery inside a photosensitive body cleaner.

FIG. 2 is a drawing that schematically shows a cleaning blade periphery inside a photosensitive body cleaner.

In the present exemplary embodiment, a pressure unit 171, is provided on an upstream side (that is, a transfer unit 16 side) of a location at which the cleaning blade 170 and the surface of the photosensitive body 12 contact, with one another. The pressure unit 171 includes a solenoid 172 and a pressure member 173, and the pressure member 173 is attached to a tip of a core of the solenoid 172. In addition, the pressure unit 171 also includes a drawn spring 174 that draws the pressure member 173 and a main body of the solenoid 172 toward one another. The actions of the pressure unit 171 are controlled by the control unit 11 that is shown in FIG. 1, the pressure member 173 is drawn up to the top of FIG. 2 by the drawn spring 174 when the solenoid 172 is off, and the pressure member 173 is pushed by the solenoid 172 and moves toward the bottom of FIG. 2 when the solenoid 172 is turned on. The pressure unit 171 corresponds to an example of a pressure device that is referred to in the present invention.

Actions of the present exemplary embodiment which is provided with this kind of pressure unit 171 will be described next.

During normal image formation, as shown in FIG. 2, the surface of the photosensitive body 12 moves to a right direction in the drawing, the surface of the photosensitive body 12 is scrubbed by the edge of the cleaning blade 170, and residual objects are scraped away. As a result of this, piled bodies 175 of the residual objects are generated along the edge of the cleaning blade 170. In the present exemplary embodiment, the piled bodies 175 are formed by toner dams 175*a* that, are mainly formed from toner, and external additive dams 175*b* that are mainly formed from external additive, and since the particle diameter of the external additive is small, the external additive dams 175*b* are formed in locations that are closer to the edge than the toner dams 175*a*. Additionally, in FIG. 2, the toner dams 175*a* and the external additive dams 175*b* are shown conceptually, and the specific shapes and the like thereof are not shown accurately.

In a case in which image formation by the printer 10 satisfies a condition such as reaching a predetermined number of sheets for example, a reinforcement action of the piled bodies 175 is performed as a result of the control of the control unit 11 that is shown in FIG. 1 during a pause of an interval in image formation.

Figure 3:
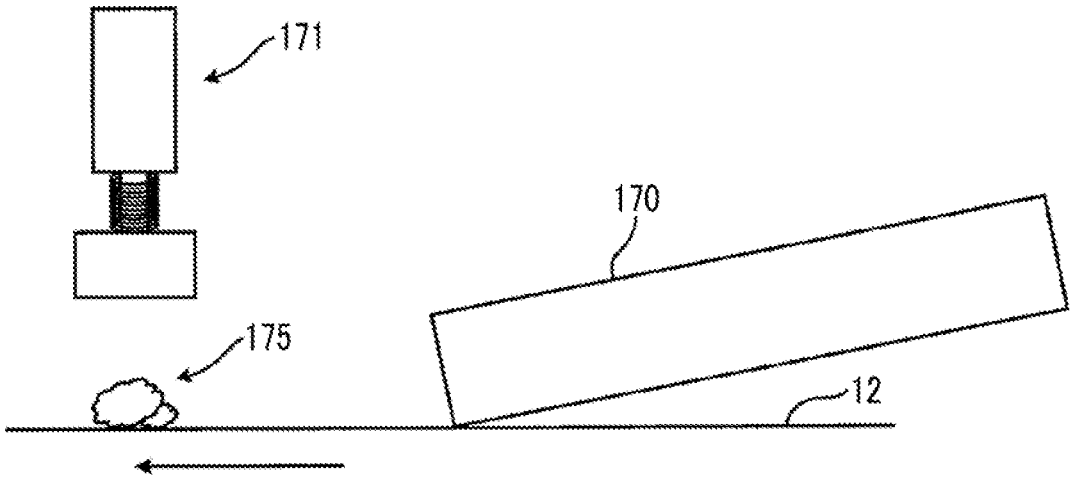
FIG. 3 is a drawing that shows an aspect during reversal in a reinforcement action of a piled body.
Figure 4:
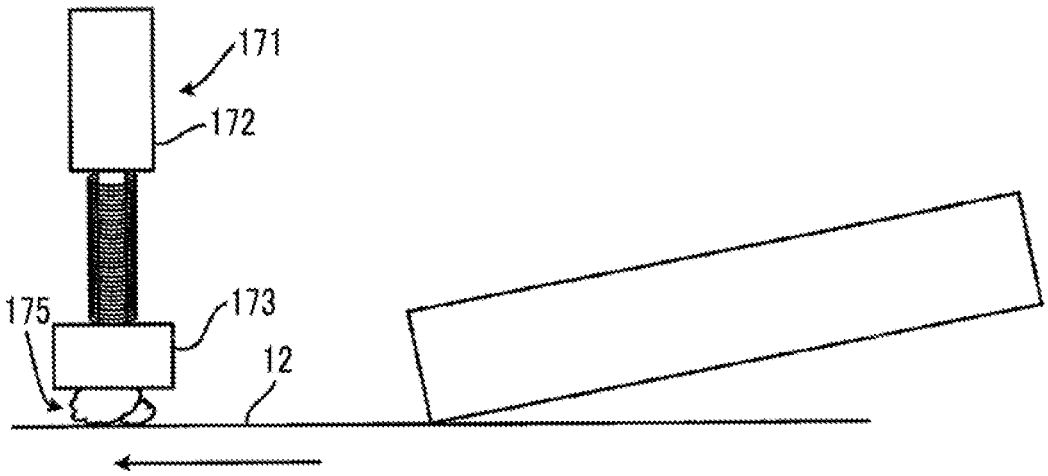
FIG. 4 is a drawing that shows an aspect during pressure in the reinforcement action of the piled body.
Figure 5:
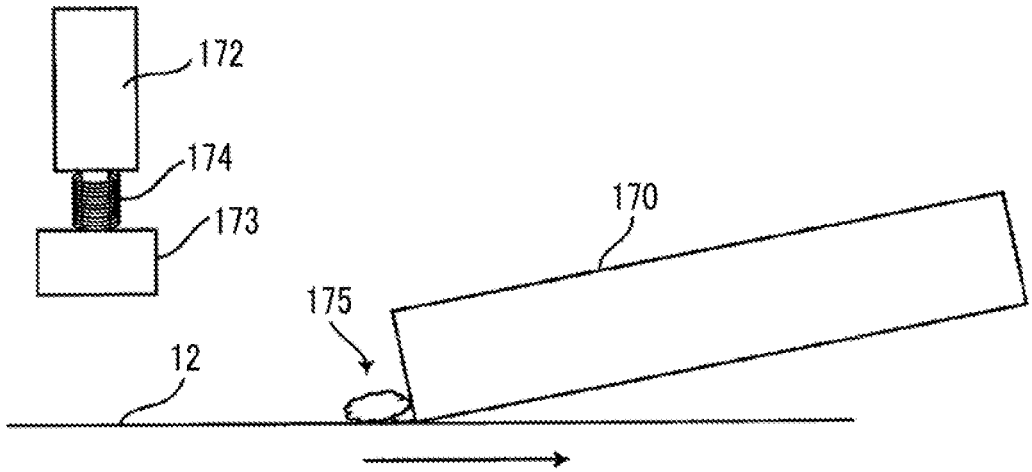
FIG. 5 is a drawing that shows an aspect during normal rotation return in the reinforcement action of the piled body.

FIGS. 3 to 5 are drawings that show a reinforcement action of piled bodies.

When the reinforcement action of the piled bodies is initiated, the control unit 11 gives an instruction for the reversal of the photosensitive body 12. As shown in FIG. 3, the photosensitive body 12 is reversed to an extent that the piled bodies 175 move from the edge of the cleaning blade 170 to below (that is, a facing location between the pressure unit 171 and the photosensitive body 12) the pressure unit 171.

After reversal in this manner, as shown in FIG. 4, pressure is performed by the pressure unit 171. That is, the solenoid 172 pushes the pressure member 173 out as a result of a driving signal being delivered from the control unit 11 to the solenoid 172, and the piled bodies 175 are pressed between the pressure member 173 and the photosensitive body 12. For example, it is preferable that the pressure be 3.0 g/cm$^2$, as a result of this pressure, the piled bodies 175 are pressed together and reinforced. In addition, as a result of the pressure, oil component seeps out from the external additive that is included in the piled bodies 175, and the oil exhibits an effect of solidifying the piled bodies 175, and an effect of improving the lubrication of the photosensitive body 12 surface.

The piled bodies 175 that are pressed in this manner are returned to the edge of the cleaning blade 170 as shown in FIG. 5. That is, the drawn spring 174 draws the pressure member 173 back as a result of the driving signal from the control unit 11 to the solenoid 172 being shut off, and the piled bodies 175 return to the edge of the cleaning blade 170 as a result of the photosensitive body 12 rotating in the right direction in the drawing under the control of the control unit 11. In this manner, since the piled bodies 175 that have returned to the edge are pressed together and reinforced, even in a case in which low concentration images are formed continuously, it is difficult for the piled bodies 175 to be reduced, and therefore, cleaning ability by the cleaning blade 170 is stabilized.

Additionally, for example, the pressure device that is referred to in the present invention may be a pressure device which is provided on a side of the edge of the cleaning blade 170, and which continuously applies pressure to the piled bodies 175, but from a viewpoint of preventing a so-called filming phenomenon in which components of toner melt, and take on a filmy form and become adhered to the photosensitive body 12 surface, it is desirable that the pressure of the piled bodies 175 is temporary.

Second Exemplary Embodiment

The description of the first exemplary embodiment has been completed above, and next, the second exemplary embodiment will be described. Since, apart from the structure of the cleaning blade 170 periphery inside the photosensitive body cleaner 17 differing, the second exemplary embodiment is the same as the first exemplary embodiment, overlapping description will be omitted.

Figure 6:
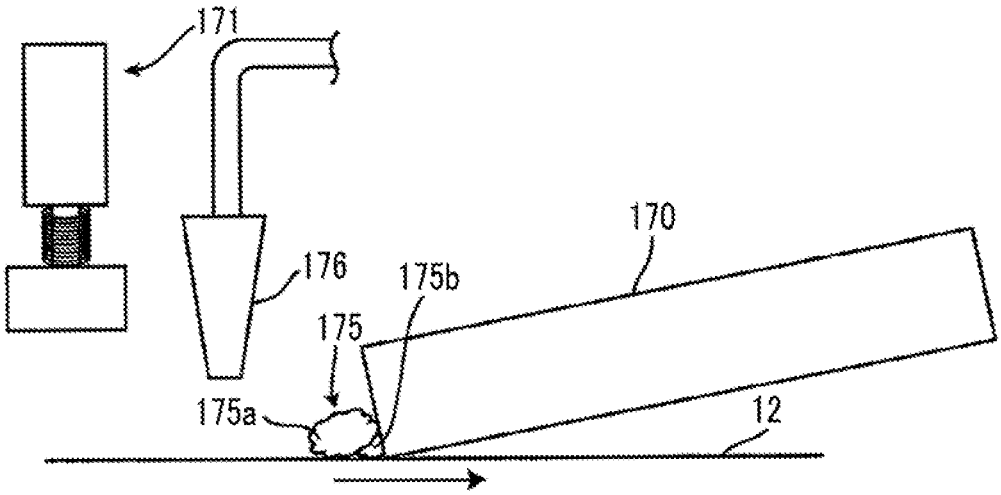
FIG. 6 is a drawing that schematically shows a cleaning blade periphery inside a photosensitive body cleaner in a second exemplary embodiment.

FIG. 6 is a drawing that schematically shows a cleaning blade periphery inside a photosensitive body cleaner in the second exemplary embodiment.

In the second exemplary embodiment, the pressure unit 171, is provided on an upstream side (that is, a transfer unit 16 side) of a location at which the cleaning blade 170 and the surface of the photosensitive body 12 contact with one another. In addition, in the second exemplary embodiment, a nozzle of an air discharging unit 176 is provided between the cleaning blade 170 and the pressure unit 171. The air discharging unit 176 includes a pipe and a pump (not illustrated) that deliver air to the nozzle shown in FIG. 6, and the discharging of air from the nozzle is turned on and off in accordance with the control of the control unit 11 that is shown in FIG. 1.

Actions of the second exemplary embodiment will be described.

During normal image formation, as shown in FIG. 6, the surface of the photosensitive body 12 moves to the right direction in the drawing, the surface of the photosensitive body 12 is scrubbed by the edge of the cleaning blade 170, and residual objects are scraped away. As a result of this, the piled bodies 175 are generated along the edge of the cleaning blade 170. In the second exemplary embodiment, the piled bodies 175 are also formed by the toner dams 175*a*, and the external additive dams 175*b*. In addition, in the second exemplary embodiment, a reinforcement action of the piled bodies 175 is also performed as a result of the control of the control unit 11 that is shown in FIG. 1 during a pause of an interval in image formation.

FIGS. 7 to 10 are drawings that show a reinforcement action of piled bodies in the second exemplary embodiment.

Figure 7:
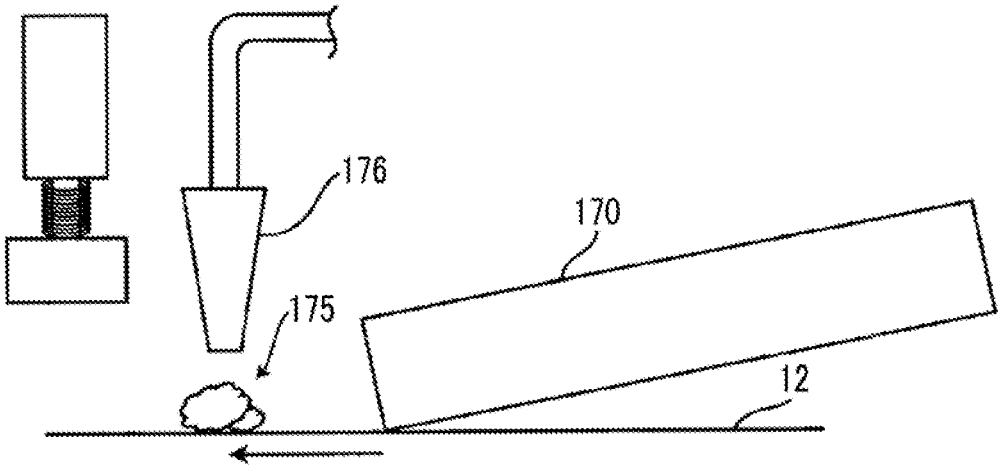
FIG. 7 is a drawing that shows an aspect during reversal in a reinforcement action of a piled body in the second exemplary embodiment.

When the reinforcement action of the piled bodies is initiated, the control unit 1 gives an instruction for the reversal of the photosensitive body 12. As shown in FIG. 7, in the second exemplary embodiment, the photosensitive body 12 is reversed to an extent that the piled bodies 175 move from the edge of the cleaning blade 170 to below (that is, a facing location between the nozzle and the photosensitive body 12) the nozzle of the air discharging unit 176.

Figure 8:
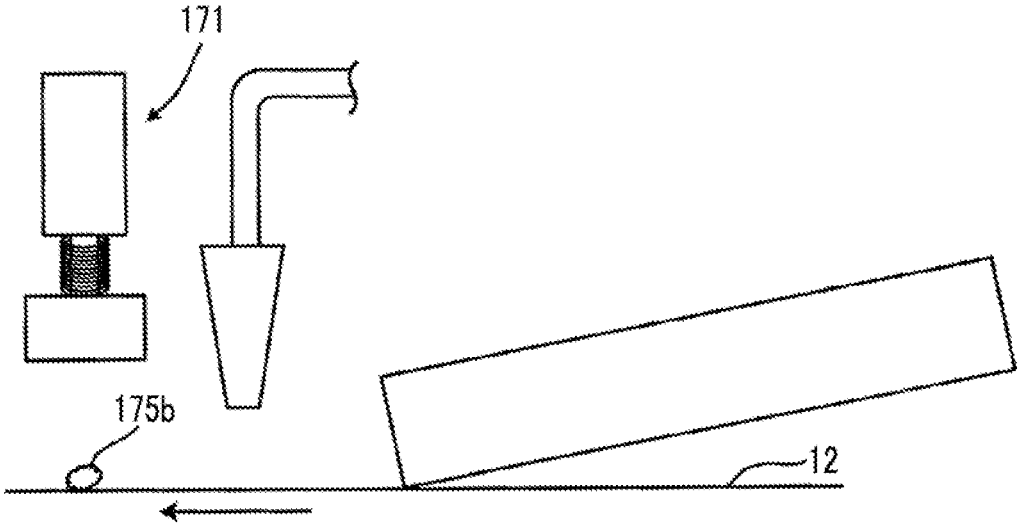
FIG. 8 is a drawing that shows an aspect during a second reversal in the reinforcement action of the piled body in the second exemplary embodiment.

After reversal in this manner, the discharging of air by the air discharging unit 176 is performed, and components of the toner dams 175*a* are blown away from the piled bodies 175. As a result of this, as shown in FIG. 8, piled bodies in which the components of the external additive dams 175*b* are largely predominant remain. The air discharging unit 176 corresponds to an example of a reduction unit that is referred to in the present invention. In this manner, it is desirable that a ratio of the external additive with respect to toner in the remaining piled bodies is greater than or equal to 100% in weight ratio. Further, the control unit 11 gives an instruction for a second reversal of the photosensitive body 12, and the external additive dams 175*b*, which is the piled bodies 175, is moved to below (that is, a facing location between the pressure unit 171 and the photosensitive body 12) the pressure unit 171.

Figure 9:
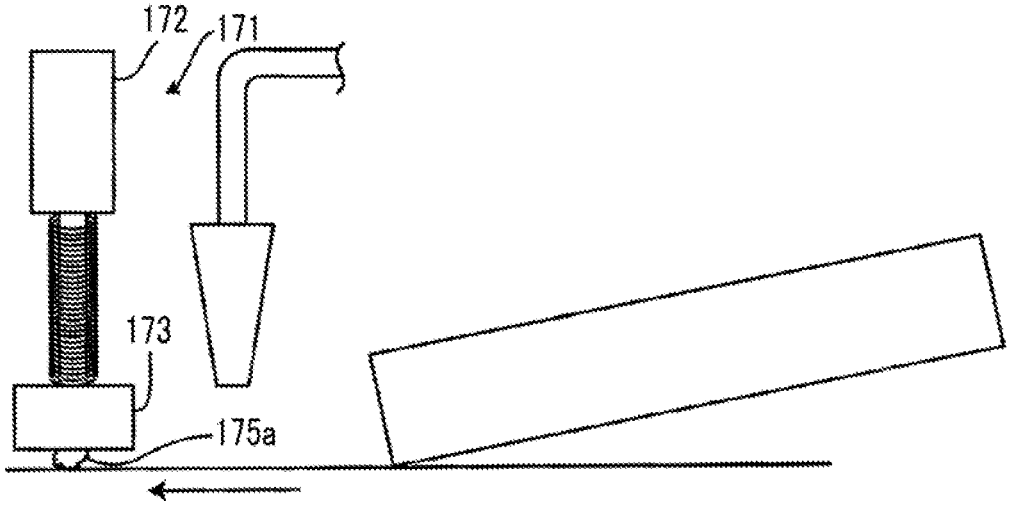
FIG. 9 is a drawing that shows an aspect during pressure in the reinforcement action or the piled body in the second exemplary embodiment.

Next, as shown in FIG. 9, pressure is performed by the pressure unit 171. That is, the solenoid 172 pushes the pressure member 173 out as a result of a driving signal being delivered from the control unit 11 to the solenoid 172, and the external additive dams 175*b* (the piled bodies) are pressed between the pressure member 173 and the photosensitive body 12. As a result of the pressure, the external additive dams 175*b* (the piled bodies) are pressed together and reinforced. At this time, oil component seeps out from the external additive, and exhibits the same effect of solidifying the piled bodies, and the effect of improving the lubrication of the photosensitive body 12 surface in the same manner as the first exemplary embodiment, but since the ratio of the predominant external additive in the piled bodies is high, the piled bodies are solidified more tightly than the first exemplary embodiment.

Figure 10:
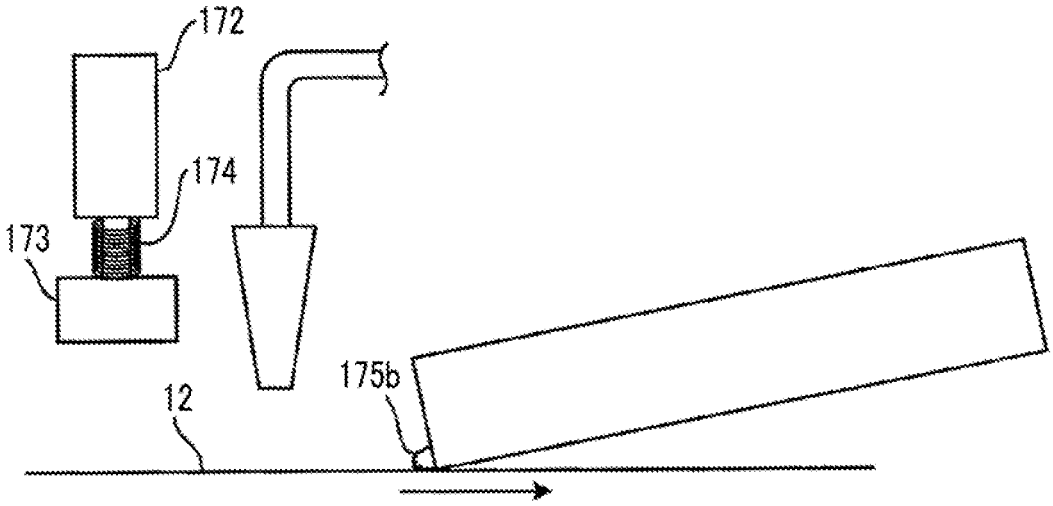
FIG. 10 is a drawing that shows an aspect during normal rotation return in the reinforcement action of the piled body in the second exemplary embodiment.

The external additive dams 175*b* (piled bodies) that are pressed in this manner are returned to the edge of the cleaning blade 170 as shown in FIG. 10. That is, the drawn spring 174 draws the pressure member 173 back as a result of the driving signal from the control unit 11 to the solenoid 172 being shut off, and the external additive dams 175*b* (piled bodies) return to the edge of the cleaning blade 170 as a result of the photosensitive body 12 rotating in the right direction in the drawing under the control of the control unit 11. In this manner, since the external additive dams 175*b* (the piled bodies) that have returned to the edge are reinforced more than in the first exemplary embodiment, cleaning ability by the cleaning blade 170 is further stabilized.

Third Exemplary Embodiment

The description of the second exemplary embodiment has been completed above, and next, the third exemplary embodiment will be described. Since, apart from the structure of the cleaning blade 170 periphery inside the photosensitive body cleaner 17 differing, the third exemplary embodiment is the same as the first exemplary embodiment, overlapping description will be omitted.

Figure 11:
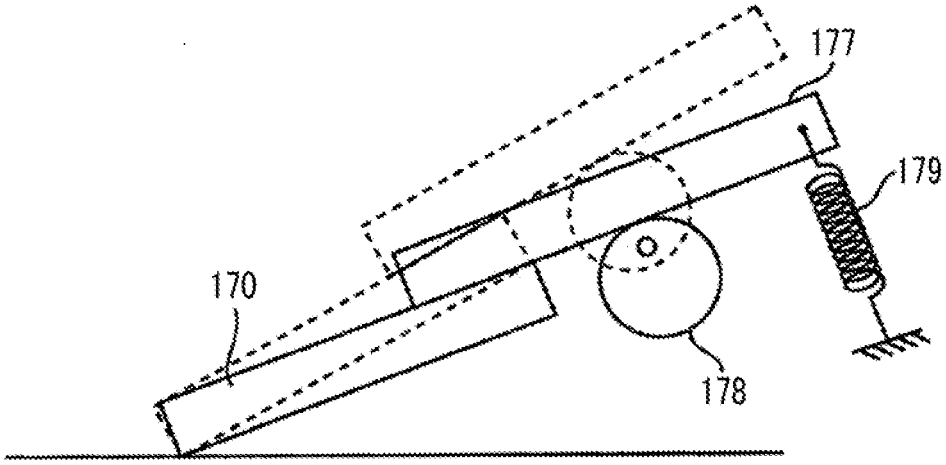
FIG. 11 is a drawing that schematically shows a cleaning blade periphery inside a photosensitive body cleaner in a third exemplary embodiment.

FIG. 11 is a drawing that schematically shows a cleaning blade periphery inside a photosensitive body cleaner in the third exemplary embodiment.

In the third exemplary embodiment, the cleaning blade 170 and a metal holding plate 177, which holds the cleaning blade 170 freely rotate in an integral manner through an angular range of an extent in which a location (the edge) at which the cleaning blade 170 and the photosensitive body 12 surface contact with one another is set as a center. Further, a rotation cam 178 for rotating the metal holding plate 177 on the cleaning blade 170, and a drawn spring 179 are provided. By the drawn spring 179, the metal holding plate 177 is drawn so as to always contact with the rotation cam 178, and the posture of cleaning blade 170 and the metal holding plate 177 changes from a first state that is shown by a solid line in the drawing to a second state that is shown by a dotted line in the drawing as a result of the rotation cam 173 rotating. The rotation cam 178 is rotated by a motor, which is not illustrated, and the driving of the motor and the rotation cam 178 is controlled by the control unit 11 that is shown in FIG. 1.

Actions of the third exemplary embodiment will be described.

Figure 12:
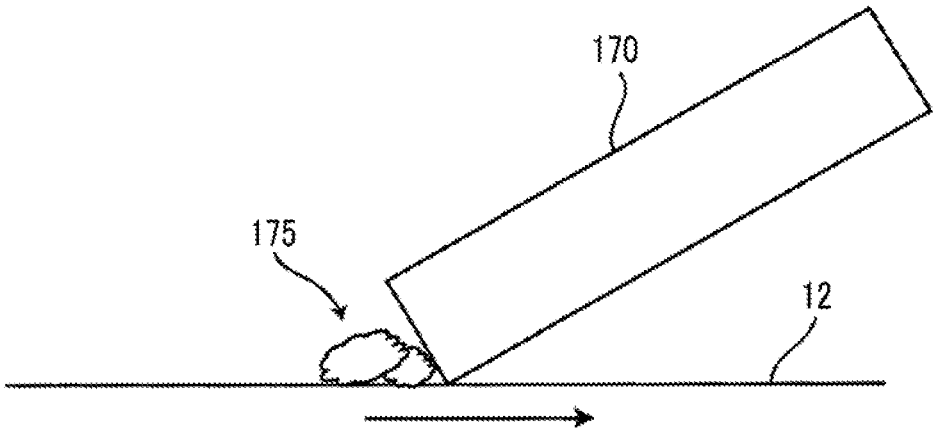
FIG. 12 is a drawing that shows an aspect during normal image formation in the third exemplary embodiment.

FIG. 12 is a drawing that shows an aspect during normal image formation in the third exemplary embodiment.

During normal image formation, the cleaning blade 170 is in the first state that is mentioned above, and the surface of the photosensitive body 12 moves to the right direction in the drawing, the surface of the photosensitive body 12 is scrubbed by the edge of the cleaning blade 170, and residual objects are scraped away. As a result of this, the piled bodies 175 of the residual objects are generated along the edge of the cleaning blade 170. In addition, in the third exemplary embodiment, a reinforcement action of the piled bodies 175 is also performed as a result of the control of the control unit 11 that is shown in FIG. 1 during a pause of an interval in image formation.

Figure 13:
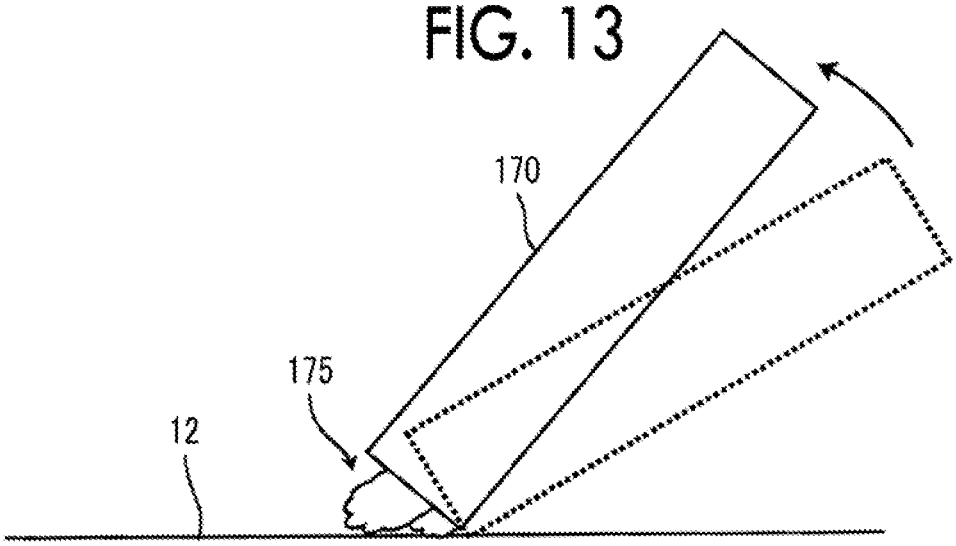
FIG. 13 is a drawing that shows an aspect during pressure in a reinforcement action of a piled body in the third exemplary embodiment.
Figure 14:
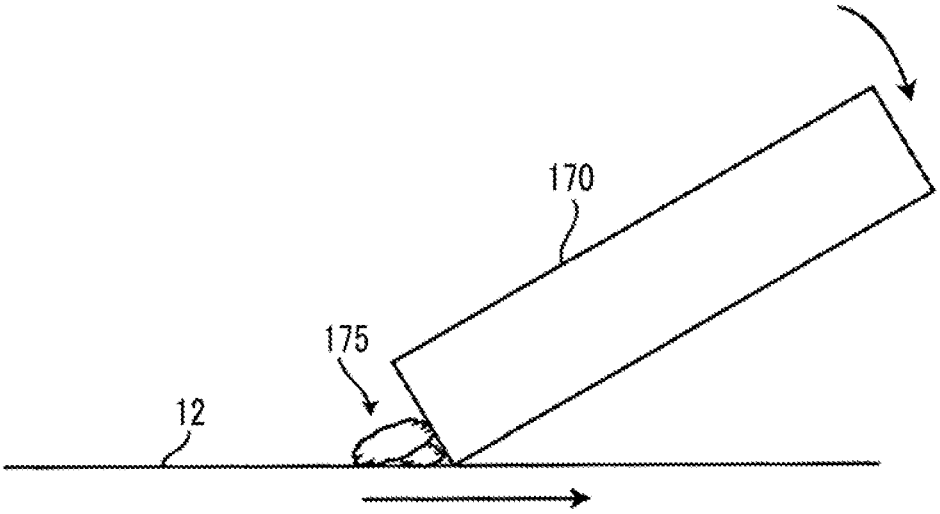
FIG. 14 is a drawing that shows an aspect during posture return in the reinforcement action of the piled body in the third exemplary embodiment.

FIGS. 13 and 14 are drawings that show a reinforcement action of piled bodies in the third exemplary embodiment.

When the reinforcement action of the piled bodies is initiated, the control unit 11 gives an instruction for the stop of the photosensitive body 12, and the control unit 11 drives the rotation cam 178 that is shown in FIG. 11, and as shown in FIG. 13, the cleaning blade 170 rises to the second state that is mentioned above. In this manner, as a result of the change in the posture of the cleaning blade 170, the piled bodies 175 are interposed between the tip end of the cleaning blade 170 and the photosensitive body 12 surface, and the piled bodies 175 are pressed. In other words, in the third exemplary embodiment, the cleaning blade 170 also functions as the pressure device that is referred to in the present invention.

Even in pressure with this kind of technique, the piled bodies 175 are pressed together and reinforced. In addition, in the third exemplary embodiment, oil component also seeps out from the external additive that is included in the piled bodies 175 by pressure, and the oil exhibits the effect of solidifying the piled bodies 175, and the effect of improving the lubrication of the photosensitive body 12 surface.

When the piled bodies 175 are reinforced by pressure, the rotation cam 178 that is shown in FIG. 11 is driven by the control unit 11, and as shown in FIG. 14, the cleaning blade 170 returns to the first state that is mentioned above. Further, rotation of the photosensitive body 12 is restarted, and the reinforced piled bodies 175 are pushed against the edge of the cleaning blade 170. In the same manner as the first exemplary embodiment, even in a case in which low concentration images are formed continuously, it is difficult for the piled bodies 175 that are reinforced in this manner to be reduced, and therefore, cleaning ability by the cleaning blade 170 is stabilized.

Additionally, in the above-mentioned exemplary embodiments, an example in which toner components in the piled bodies are reduced by the discharging of air is shown as a reduction unit that is referred to in the present invention, but, for example, the reduction unit may be a device that reduces a toner component using an electrostatic effect or the like.

In addition, in the above-mentioned exemplary embodiments, a monochrome printer is illustrated by way of example, but the present invention may also be applied to a color device, and may also be applied to a facsimile, a copy machine, or a multifunction machine.

In addition, in the above-mentioned exemplary embodiments, a device that forms toner images using an electrophotography method is illustrated by way of example, but the formation device that is referred to in the present invention may be a device that directly draws toner images onto an image holding body by an electrode array or the like.

In addition, in the above-mentioned exemplary embodiments, a transfer device that directly transfers toner images from a photosensitive body to sheets of paper is illustrated by way of example, but the transfer device that is referred to in the present invention may also be a device that indirectly transfers from an image holding body to a recording medium via an intermediate transfer body or the like.

In addition, in the above-mentioned exemplary embodiments, sheets of paper are illustrated as a recording medium by way of example, but the recording medium that is referred to in the present invention may be OHP sheets, or may be plastic paper or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a removal member that removes residual objects from a surface of a target cleaning body by contacting with the surface in a linear manner and rubbing against the surface and forms a piled body which is constructed of a portion of the residual objects at a contact location; and a pressure device that presses the piled body to increase a strength of the piled body, wherein the residual objects contain particles which include oil content, and wherein the pressure device presses the piled body with a pressure of larger than or equal to an extent at which the oil content seeps out from the particles.

2. The cleaning device according to claim 1, wherein the residual objects contain particles for forming an image on a surface of the target cleaning body, and an external additive that is mixed with the particles for forming the image and that has a particle diameter that is smaller than a particle diameter of the particles for forming the image, and wherein the cleaning device further comprises a reduction unit that reduces components other than the external additive in the residual objects before being pressed by the pressure device.

3. The cleaning device according to claim 1, wherein the residual objects contain toner and an external additive treated with silicone oil.

4. An image forming apparatus comprising:

an image holding body that holds images formed on a surface;

an image formation unit that forms the images;

a transfer unit that transfers the images onto a recording medium from the image holding body;

a removal member that removes residual objects from a surface of the image holding body by contacting with the surface in a linear manner and rubbing against the surface and forms a piled body which is constructed of a portion of the residual objects at a contact location and; and a pressure device that presses the piled body to increase a strength of the piled body, wherein the residual objects contain particles which include oil content, and wherein the pressure device presses the piled body with a pressure of larger than or equal to an extent at which the oil content seeps out from the particles.

5. The image forming apparatus according to claim 4, wherein the residual objects contain particles for forming the images on a surface of the image holding body, and an external additive that is mixed with the particles for forming the images and that has a particle diameter that is smaller than a particle diameter of the particles for forming the images, and wherein the image forming apparatus further comprises a reduction unit that reduces components other than the external additive in the residual objects before being pressed by the pressure device.

* * * * *